United States Patent [19]

Frankfort et al.

[11] 4,186,859

[45] Feb. 5, 1980

[54] CONVERTIBLE BAG APPARATUS

[76] Inventors: Roberta L. Frankfort, 165 West End Ave., New York, N.Y. 10023; Donna L. Madonna, 120 Cabrini Blvd., New York, N.Y. 10033

[21] Appl. No.: 929,522

[22] Filed: Jul. 31, 1978

[51] Int. Cl.[2] ..... A45C 9/00

[52] U.S. Cl. ..... 224/205; 224/42.46 R; 224/46 R

[58] Field of Search ..... 224/42.01, 42.46 R, 224/46 R, 8 R, 9, 31, 32 R, 32 A, 47, 36, 30 A, 35, 202, 205, 191, 204, 206, 235, 236, 257, 258; 150/1 R, 12, 47, 33; 280/202, 289 R

[56] References Cited

U.S. PATENT DOCUMENTS

| | | | |
|---|---|---|---|
| 954,840 | 4/1910 | Wiedemann | 224/46 R UX |
| 2,308,003 | 1/1943 | Gamrod | 225/5 V |
| 2,394,782 | 2/1946 | Kalske | 224/46 R |
| 2,451,142 | 10/1948 | Zimmern | 224/46 R |
| 3,955,728 | 5/1976 | Jackson et al. | 224/31 |

FOREIGN PATENT DOCUMENTS

| | | | |
|---|---|---|---|
| 2702328 | 7/1977 | Fed. Rep. of Germany | 150/12 |
| 237293 | 8/1945 | Switzerland | 224/26 R |
| 399944 | 10/1933 | United Kingdom | 150/33 |
| 857965 | 1/1961 | United Kingdom | 150/33 |

*Primary Examiner*—Jerold M. Forsberg
*Attorney, Agent, or Firm*—Martin G. Raskin

[57] ABSTRACT

Bag apparatus which is convertible from a shoulder carried bag to a carriage or stroller mounted bag and vice-versa including a bag member and a pair of elongate, flexible straps each being affixed at one end portion to a respective side wall portion of the bag. First fastening means are provided on the free end portion of the straps for releasably fastening the free end portions together for shoulder carrying and second means are provided on the straps proximate to the affixed ends thereof for releasably forming a length of each strap into a closed loop section for carriage mounting whereupon the free end portion of the straps are releasably affixed to their respective bag side wall portions by said first fastening means.

3 Claims, 4 Drawing Figures

CONVERTIBLE BAG APPARATUS

BACKGROUND OF THE INVENTION

This invention relates generally to carrying bags and, more particularly, to carrying bags for use either as a shoulder carried bag or, alternatively, as a carriage or stroller mounted bag.

Carrying bag apparatus adapted to be supported on the shoulder of the person carrying it, i.e., shoulder bags, are well known. More particularly, such shoulder bags generally comprise a bag and an elongate flexible strap attached at its ends to the side wall portions of the bag. The mid-portion of the flexible strap is located on the shoulder by the wearer passing her arm through the space defined between the bag and the strap and placing the strap on her shoulder so that the bag rests against the side of her body. Such shoulder bags are advantageous in that both hands of the wearer are free even when the bag is being carried.

Carrying bags are also known which are adapted to be attached to carriages, strollers and the like. Such bags, which are usually adapted for use by mothers of infants and young childern who must be wheeled in carriages, generally are attached directly to the carriage structure. Such bags are advantageous in that the mother is not burdened by the weight of the bag and its contents since the bag is supported by the carriage itself and, further, both of the mother's hands remain free.

Generally, in the past, it has not been possible to convert a shoulder bag to a bag which is mountable on a carriage or stroller, or vice-versa. Provisions for such a convertible bag apparatus is desirable since when the child who is being wheeled in the carriage requires an article, such as a bottle, contained within a shoulder bag carried by the mother, she must stop wheeling the carriage, remove the bag from her shoulder, open it and remove the article and then reposition the bag on her shoulder, such action being rather inconvenient. Further, the shoulder bag tends to slide down on the mother's shoulder while she is wheeling the carriage since in some cases the mother must slightly stoop in order to grasp the carriage handle.

On the other hand, carriage mounted bags have little use to the mother when she is not wheeling the carriage or stroller to which it is mounted. Although such bags in some cases may be detached from the carriage, they are not suitable, after demounting, for being carried on the wearer's shoulder.

SUMMARY OF THE INVENTION

Accordingly, one object of the present invention is to provide a new and improved carrying bag apparatus.

Another object of the present invention is to provide a new and improved carrying bag apparatus which is convertible from a shoulder bag to a carriage or stroller mounted bag and vice versa.

Still another object of the present invention is to provide a new and improved convertible bag apparatus which is simple in construction, economic in manufacture and easy to convert from the shoulder bag configuration to the stroller mounted configuration.

Briefly, in accordance with the present invention, these and other objects are attained by providing a bag member having a pair of elongate flat flexible straps, each being affixed at one end portion to a respective side wall portion of the bag. First fastening means are provided on the free end portions of the strap for releasably fastening the free end portions together for conversion of the bag into a shoulder bag. Second means are provided on the strap proximate to the affixed ends thereof for releasably forming a length of each strap member into a closed loop section over a respective bar of the carriage or stroller handle. When the bag apparatus is mounted on the carriage or stroller, the first fastening means serve to releasably affix the free end portion of the straps to their respective bag side wall portions.

DESCRIPTION OF THE DRAWINGS

A more complete appreciation of the invention and many of the attendant advantages thereof will be readily appreciated as the same becomes better understood by reference to the following description in conjunction with the drawings in which.

DESCRIPTION OF THE PREFERRED EMBODIMENT

Figure 1:
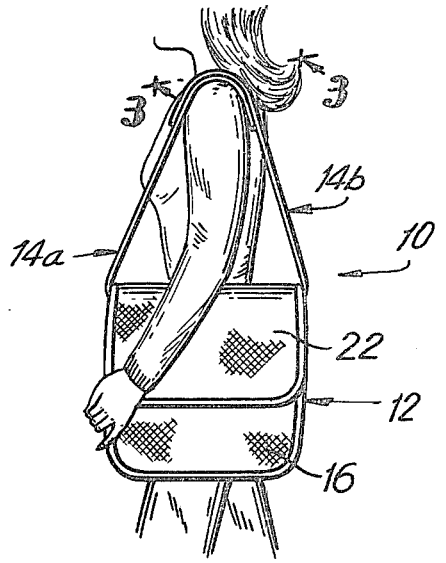
FIG. 1 is a side view of the convertible bag apparatus of the present invention being worn as a shoulder bag.
Figure 2:
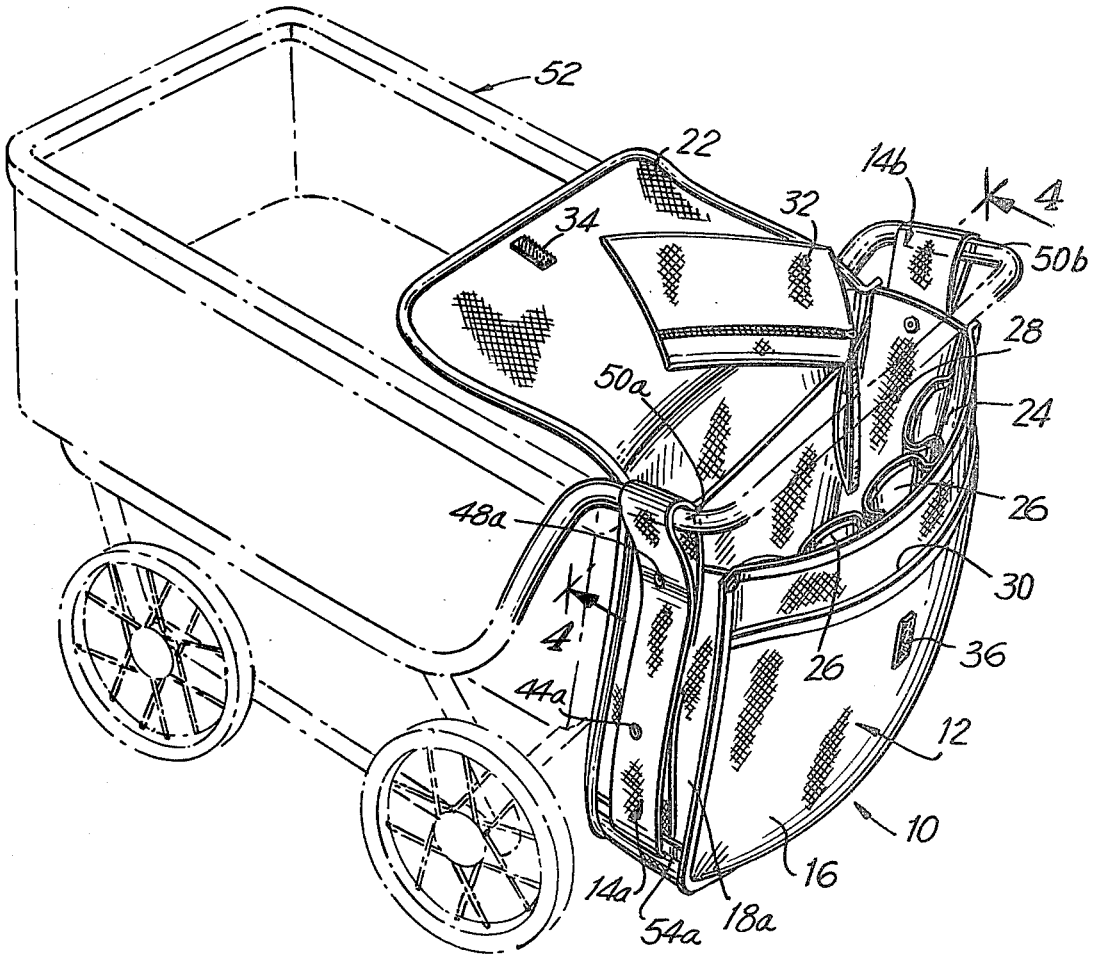
FIG. 2 is a perspective view of the convertible bag apparatus of the present invention mounted on a carriage.

Referring now to the drawings wherein like reference characters designate identical or corresponding parts throughout the several views and more particularly to FIGS. 1 and 2 thereof, a preferred embodiment of the convertible bag apparatus of the present invention, generally denoted as 10, includes a bag 12 and a pair of elongate, flexible strap members 14*a*, 14*b*. The bag 12 and strap members 14*a, b* are preferably formed of a heavy fabric material although it is understood that other materials, such for example as plastic, may be used.

The bag 12 is formed of a front wall portion 16, a rear wall portion (not shown), a pair of side wall portions 18*a, b*, a bottom wall portion 20 (FIG. 4) and a closure flap portion 22. These wall portions may be separately formed or two or more portions may be integrally formed as desired. Referring to FIG. 2, the interior of bag 12 in the present embodiment is specifically designed for use as a carrier for articles for infants, although it is understood that the bag may be designed for other uses. Thus, the bag interior is provided with a waterproof lining 24 having pockets 26 for bottles and the like and inner and outer compartments 28, 30 for other articles such as diapers, toys, clothes and the mother's possessions. A separate purse 32 may be included for smaller articles such as keys, change and the like. Fastener strips 34, 36, formed for example of Velcro material, may be provided on the inner surface of closure flap 22 and front wall portions 16 so that the bag may be securely closed.

Flexible strap members 14*a, b* each have one end portion affixed to a respective side wall portion 18*a, b* by conventional means, such for example as double headed rivets 38*a, b* (FIG. 4) which pass through the respective strap members 14 and associted side wall portions 18. The end edge of each strap member 14 is fastened to the respective side wall portions 18 by stitching 40. The outwardly facing heads of double headed rivets 38*a, b* are provided with male snap connector element portions 42*a, b* for reasons which will be made clearer hereinbelow.

Figure 3:
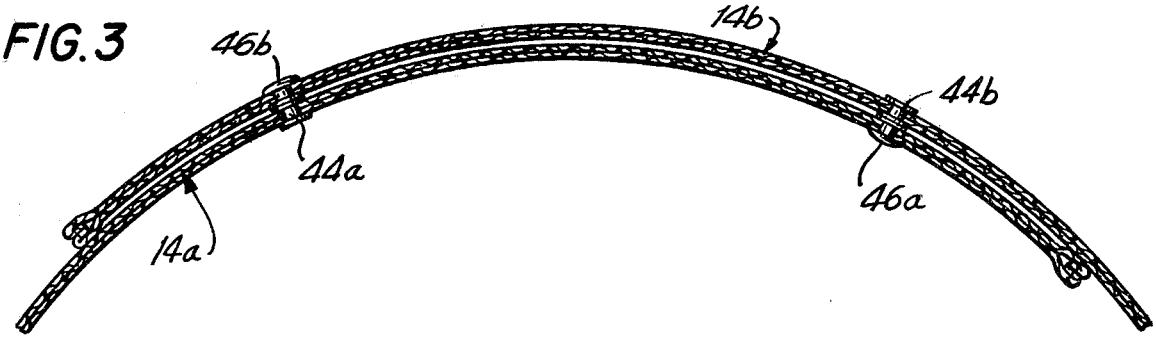
FIG. 3 is a section view taken along line 3—3 of FIG. 1 illustrating the first fastening means on the straps of the convertible bag apparatus of the present invention.
Figure 4:
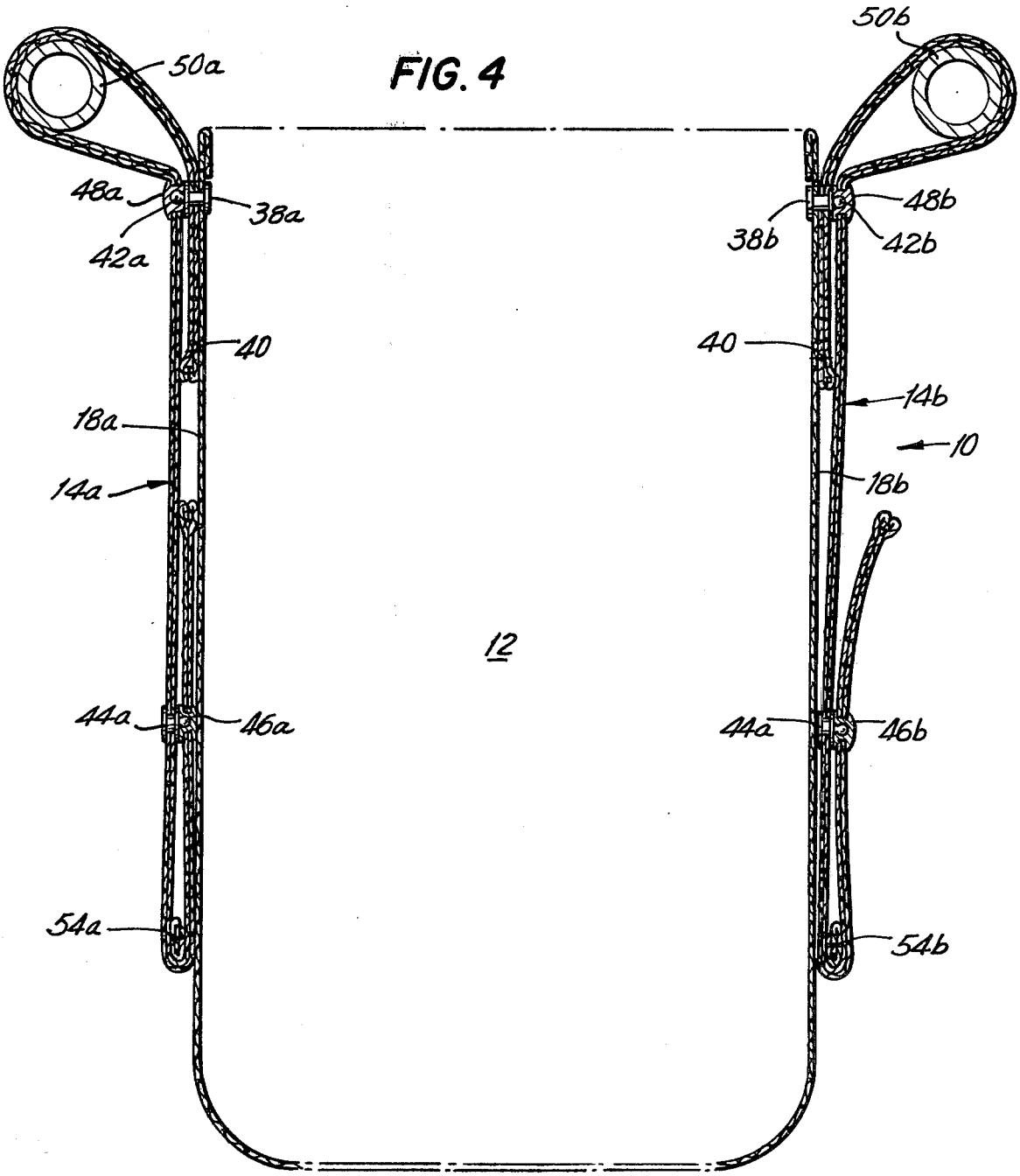
FIG. 4 is a section view taken along line 4—4 of FIG. 2 illustrating the flexible straps of the carriage mounted convertible bag apparatus of the present invention.

Referring to FIGS. 3 and 4, the free end portions of flexible strap members 14*a, b* are each provided with a pair of longitudinally spaced, male and female snap connector elements 44 and 46. Thus, referring to strap member 14*a*, an upwardly facing female snap connector element 46*a* is provided on the outer portion of strap member 14*a* and an upwardly facing male snap connector element 44*a* is provided longitudinally inwardly spaced therefrom. Referring to strap member 14*b*, a downwardly facing male snap connector element 44*b* is provided on the outer portion thereof and a downwardly facing female snap connector element 46*b* is provided longitudinally inwardly spaced therefrom. As best seen in FIG. 3, the spacing between the connector elements on the two strap members are equal so that the male and female snap connector pairs 44*a*, 46*b* and 46*a*, 44*b* align for connection with each other. Thus, as is clear from the Figures, when bag apparatus 10 is desired to be converted to its shoulder bag mode, as shown in FIG. 1, the strap members 14*a, b* are positioned so that their free end portions overlap each other as shown in FIG. 3 and the male and female strap connector element pairs are connected to each other.

Referring to FIG. 4, strap members 14*a*, 14*b* are each provided with a female snap connector element 48*a, b*, respectively, longitudinally inwardly spaced from double headed rivets 38*a, b* proximate to the affixed end portions of the strap members. Female snap connector elements 48*a, b* are disposed so that upon the section of each strap member extending between double headed rivets 38 and female snap connector elements 48 being folded over itself, the male connector element portion 42 provided on double headed rivets 38 align for connection therewith.

Thus, referring to FIGS. 2 and 4, when bag apparatus 10 is desired to be mounted over the bar portion 50*a, b* of a carriage 52, the strap members 14*a, b* are passed upwardly past the inner side of each bar portion and looped over themselves whereupon female connector elements 48*a*, 48*b* are connected with male connector element portions 42*a*, 42*b* forming a loop around each respective bar portion 50*a*, 50*b* thereby mounting bag apparatus 10 on carriage 52.

In order to avoid the free end portions of strap members 14*a, b* from loosely hanging adjacent to the bag 12 when the bag apparatus is in its carriage mounted configuration, horizontally extending fabric strips are provided extending over the width of bag side wall forming portions 18*a, b* thereby defining loops 54*a, b*. After attaching each strap member to a respective bar portion, the free end portions of each strap member is passed through a respective loop and is fixed thereto by connecting the outer snap connector elements 44, 46 on each strap member to each other. Thus, for example, the free end portion of strap member 14*a* is passed downwardly over and upwardly through loop 54*a* whereupon snap connector elements 44*a*, 46*a* are connected. It is noted that in order to avoid the necessity of manufacturing two strap members 14*a, b* having different dispositions of snap connector elements, or in other words, so that the strap members 14*a*, 14*b* may be identically formed, strap member 14*b* is passed downwardly through and upwardly over loop 54*b* whereupon snap connector elements 44*a*, 46*b* are connected to each other.

Thus, it is seen that bag apparatus 10 may easily be converted from a shoulder bag (FIGS. 1 and 3) to a carriage mounted bag (FIGS. 2 and 4) and vice versa by suitable fastening of the connector elements as described hereinabove.

It should be understood that although the preferred embodiment has been described as utilizing connector elements of the snap kind, other connector elements may be employed. For example, buttons may be substituted for the male snap connector elements and buttonholes for the female snap connector elements. Further, the strap members may be manufactured so that each cooperates with the loops 54 in an identical manner by suitably varying the disposition of the connector elements.

Obviously, numerous modifications and variations of the invention are possible in the light of the above teachings. It is therefore to be understood that within the scope of the appended claims the invention may be practiced otherwise than is specifically described herein.

We claim:

1. Bag apparatus adapted to be convertible between a shoulder carried mode and a mode wherein the bag is suspended from support members, such as handle bars of a carriage or the like, comprising:

a bag member including opposed front and rear wall portions, a pair of opposed side wall portions and a bottom wall portion;

a pair of elongate, flexible strap members, each of said strap members being affixed at one end portion thereof to a respective side wall portion of said bag member;

first means provided on said strap members for releaseably fastening the free end portions thereof to each other wherein said bag apparatus is in said shoulder carried mode, said first releaseable fastening means comprising on each strap member outer and inner mutually engageable first connector elements, said outer first connector element being provided on the free end portion of said strap member and the inner first connector element being provided on said strap member longitudinally spaced a predetermined distance from said outer first connector element in a manner such that the outer first connector element provided on one of said strap members is engageable with the inner first connector element on the other strap member and the inner first connector element provided on said one of said strap members is engageable with the outer first connector element on said other strap member;

second means provided on each of said strap members for releaseably forming a closed loop defined by a relatively short length of said strap member folded over itself in the vicinity of the respective upper edge of said bag side wall portion to which said strap member is affixed, said loop being formable about one of the support members to convert the bag to the suspended mode, said second means comprising on said length of each strap member outer and inner mutually engageable second connector elements, said outer second connector element being provided in the region of the affixed end portion of said strap member and the inner second connector element being provided on said strap member length longitudinally spaced a predetermined distance from said outer second connector element in a manner such that upon folding each of said strap member lengths over itself to form a closed loop, said outer and inner second connector elements are located in opposed relationship to each other whereby they are mutually engageable to form a closed loop;

said first releaseable fastening means further further constituting means for releaseably fastening the free end portions of said strap members to respective bag side wall portions when the bag apparatus is in the suspended mode, said releaseable fastening means further including a loop member provided on each of said bag side wall portions having its ends affixed thereto, whereby upon forming said closed loop sections, said strap member free end portions are each passed through a respective loop member and folded upon itself so that the inner and outer first connector elements are located in opposed relationship to each other whereby they are mutually engaged to form a closed loop around a respective loop member so that each strap member is thereby fastened to a respective side wall portion.

2. Apparatus as recited in claim 1 wherein said first releasable fastening means comprises on each strap member a male connector element and a female connector element, one of said connector elements being provided on the free end portion of said strap member and the other connector element being provided on said strap member longitudinally spaced a predetermined distance from said one connector element.

3. Apparatus as recited in claim 2 wherein said first releasable fastening means on one of said strap members includes an outer male connector element provided on the free end portion thereof and an inner female connector element provided on said strap member longitudinally spaced a predetermined distance from said outer male connector element and wherein said first releasable fastening means on the other strap member includes an outer female connector element provided on the free end portion thereof and an inner male connector element provided on said other strap member longitudinally spaced said predetermined distance from said outer female connector element, said male connector elements being engageable with said female connector elements.

* * * * *